US008716178B2

(12) United States Patent
VanDemark

(10) Patent No.: US 8,716,178 B2
(45) Date of Patent: May 6, 2014

(54) ONE-PLY TWO-SIDED THERMAL IMAGING LABELS

(75) Inventor: Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 417 days.

(21) Appl. No.: 12/655,011

(22) Filed: Dec. 22, 2009

(65) Prior Publication Data

US 2011/0152076 A1 Jun. 23, 2011

(51) Int. Cl.
*B41M 5/30* (2006.01)
*G09F 3/02* (2006.01)

(52) U.S. Cl.
USPC ..... 503/206; 503/226

(58) Field of Classification Search
CPC ..... B41M 5/30; G09F 3/02; G09F 3/0291; G09F 2003/0211
USPC ..... 503/206, 226
See application file for complete search history.

(56) References Cited

U.S. PATENT DOCUMENTS

| | | | | |
|---|---|---|---|---|
| 6,186,554 | B1 | 2/2001 | Raming | |
| 6,213,518 | B1 | 4/2001 | Raming | |
| 6,786,263 | B1 | 9/2004 | Fox et al. | |
| 6,801,233 | B2 * | 10/2004 | Bhatt et al. | 347/175 |
| 7,588,811 | B2 | 9/2009 | Blank et al. | |
| 8,067,335 | B2 * | 11/2011 | Roth et al. | 503/206 |

OTHER PUBLICATIONS

"Fox IV Packslip Label Brochure", (Downloaded from the Internet Dec. 22, 2009), 2 pgs.

* cited by examiner

*Primary Examiner* — Bruce H Hess
(74) *Attorney, Agent, or Firm* — Charles Q. Maney; Joseph P. Merhle

(57) ABSTRACT

A print media representing a label is constructed having two components. A first component is capable of being thermally imaged on both a front and back side of the print media. The second component is affixed to the first component but capable of being separated there from. Also, the second component includes adhesive material along a portion of its backside to adhere the print media to an object.

5 Claims, 4 Drawing Sheets

105
104
100
105
101, 102, 103
105

100
105
104
101, 102, 103

104
105
100
101, 102, 103
105

100
105
104
101, 102, 103
105

104
105
100
101, 102, 103
105

105

ONE-PLY TWO-SIDED THERMAL IMAGING LABELS

BACKGROUND

Enterprises that ship goods to other enterprises or that ship goods to consumers sustain substantial expense in shipping those goods. Moreover, the marketplace makes it difficult for enterprises to fully charge for the expense associated with shipping the products. This is especially true in today's highly-competitive and challenging economic environment.

In addition to expense, the entire planet is becoming more environmentally conscious, such that those enterprises that can decrease their environment footprint are more favorably looked upon in the marketplace. By definition, the shipping of goods entails a variety of environmental waste. The challenge is how to reduce that waste so as to lessen the subsequent environmental impacts that occur when the waste is disposed of into the environment.

Typically, conventional printing of packing and mailing labels, for goods within an enterprise, is one-sided. These means that multiple individual pieces of paper, each comprising, for example, a single substrate, are needed to successfully ship. Some times, multiple machines are needed as well to both print the packing and mailing labels and to properly integrate them into the packing of goods being shipped. This situation adds to the expense associated with shipping by requiring more materials, more machinery for the shipping process, and in some cases more support personnel to maintain and support the shipping process.

Furthermore, conventional shipping waste generally requires separate pieces of paper comprising, for example, separate substrates, for both the mailing and packing labels; both of which are eventually disposed of into the environment. However, the mailing and packing labels are also associated with liners each of which comprises, for example, a single substrate, from which they are peeled off and eventually applied to a product. So, there may be as many as three or in some cases even four pieces of paper that have to be eventually disposed of into the environment.

SUMMARY

In various embodiments, two-sided thermal imaging labels are presented. According to an embodiment, a label is presented. The label includes a first portion, a second portion, a third portion, and a fourth portion. The first portion is situated on a front side of the media comprising the label and coated with one or more thermally-sensitive (e.g., direct thermal) inks. The second portion is situated on a back side of the media and coated with one or more thermally sensitive inks. The third portion comprises both the first and second portions. The fourth portion is perforated and/or die-cut (including partially perforated and/or partially die cut) so as to delineate the third and the fourth portions, and permit the third portion to be removable from the fourth portion. Preferably, the media comprises a one-ply/single substrate construct and the labels comprise one-ply two-sided thermal labels.

Depending on the embodiment, two-sided thermal imaging labels (e.g., one-ply two-sided thermal imaging labels) may comprise single cut media sheets each of which comprises one or more individual labels. Alternatively, one-ply two-sided thermal imaging labels may be fan-folded (with or without perforations and/or die cuts, including partial perforations and/or partial die cuts, along, for example, each individual fold), wherein each folded sheet may include one or more individual labels. Further, in other embodiments, one-ply two-sided thermal imaging labels may comprise continuous strip media (e.g., a web) having a front surface and an opposite back surface wound in a roll. Variously, the back surface may include adhesive in, e.g., patch, strip, stripe, or other patterned (including stippled) configuration, or full/flood coat, and the front surface may include strip, stripe, or other patterned (including stippled) configuration, or full/flood coat, of release material, both of which may extend along a running axis of the web such that the release material is laminated to and covers the back side adhesive in successive layers of the roll.

DETAILED DESCRIPTION

Figures 1A, 1B, 1C, 1D, 1E:
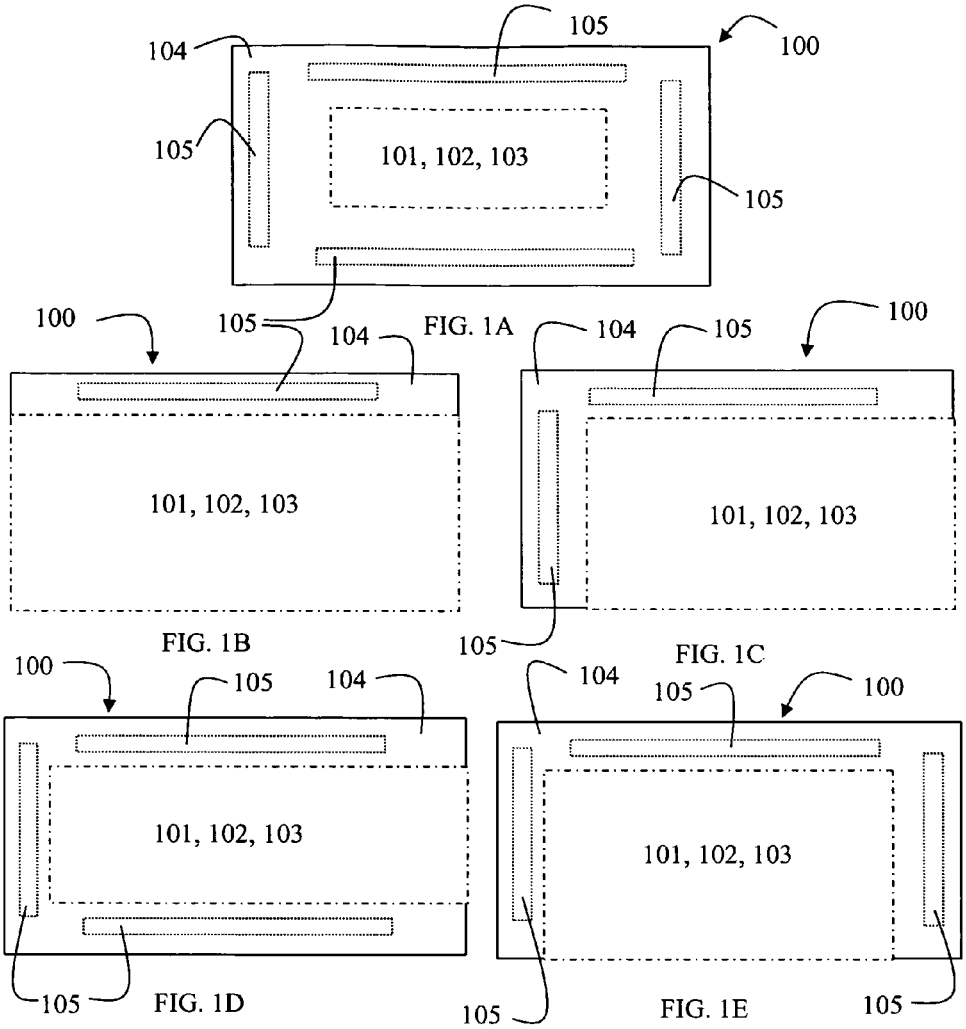
FIGS. 1A-1F are diagrams of different configurations for a label apparatus, according to example embodiments.

FIGS. 1A-1E are diagrams of different configurations for a label 100, according to example embodiments. FIGS. 1A-1E are shown for purposes of illustration only. Different configurations are achievable with the teachings presented herein.

In each of the FIGS. (FIGS. 1A, 1B, 1C, 1D, 1E, and 1F) a label 100 is depicted. Each label 100 (hereinafter "label") includes a first portion 101, a second portion 102, a third portion 103, and a fourth portion 104. The label 100 also includes an adhesive material 105. Each of these components will now be discussed in detail below.

The first portion 101 represents a front side of print media. The print media is thermally sensitive. That is, the front side of the first portion 101 is coated with thermally sensitive inks that are activated when passed through a thermal printer (e.g., a dual-sided thermal printer).

The second portion 102 represents a back side of the print media. The second portion is also coated with thermally sensitive inks that are activated when passed through a thermal printer (e.g., a dual-sided thermal printer).

The third portion 103 represents both the front and back side of the print media for the first and second portions. That is, the third portion is the first and second portion combined.

The fourth portion 104 of the print media includes a perforation and/or die cuts that separate or otherwise delineate the third portion 103 of the print media. The perforation and/or die cuts permit the third portion 103 to be removed and separated from the print media and the fourth portion 104.

In an embodiment, the third portion 103 is a receipt for a transaction once the thermally sensitive inks are selectively activated by passing through a dual-sided thermal printer to complete the transaction. That is, both the front side of the first portion 101 and the back side of the second portion 102, both of which comprise the third portion 103, are thermally imaged with, for example, information representative of the transaction such as, but not limited to, store information, payment information, and quantity, type and price of goods purchased. In another case, the first portion 101 is thermally imaged as a mailing address for one or more goods being shipped whereas the second portion 102 is a packing slip for the good(s) being shipped. So, the recipient of the good being shipped has one piece of print media having both the address label and the packing slip on the front and back sides of the third portion 103.

In other cases, information permitted or desired to be front-facing and/or visible when a label 100 is applied to an object, such as but not limited to a product or container (e.g., a box, bag, cup, or the like, including without limitation a container for or containing a product), is printed on the front side of the label 100 (e.g., a first portion 101), and information permitted or desired to be back-facing and/or hidden from external view is printed on the back side of the label 100 (e.g., a second portion 102). In one embodiment, a label 100, in either individual (e.g., sheet) or continuous (e.g., fan folded or rolled web) form is printed with first information on a front side of the label 100 (e.g., first portion 101), and second information on a back side of the label 100 (e.g., second portion 102), wherein the label 100 is then affixed to an object such that the first information is visible from the exterior of the object and the second information is hidden from exterior view, facing the object. Depending on the embodiment, information permitted or desired to be visible may include shipping (e.g., addressor and/or addressee), and/or select receipt (e.g., product quantity and/or type) information, and information which is permitted or desired to be hidden may include coupon, contest, advertising, payment (e.g., means and/or amount) and/or payor, terms and conditions, and/or confidential information.

Continuing with the previous embodiment, the label 100 may further include dual or two or more different colors on both the first 102 and second 103 portions of the receipt. So, the thermally sensitive coatings can include multiple colors that are activated during a single pass through the dual-sided thermal printer.

In an embodiment, the fourth portion 104 is configured or situated along a perimeter of the print media and the third portion 103 is configured as a center portion of the print media. This embodiment is shown in FIG. 1A.

In another configuration of the label 100 shown in FIGS. 1B, 1C, 1D, and 1E, the fourth portion 104 is configured along at least one outer edge of the print media, with the third portion 103 configured along at least some parts of remaining edges for the print media.

FIG. 1B shows the fourth portion 104 along a top edge of the print media with the third portion 103 comprising the center and remaining three outer edges of the print media. It is noted that the orientation can be achieved in any manner, such that the fourth portion 104 can be oriented along the bottom edge of the print media. What is determined to be top or bottom is relative depending upon the thermal image occurring on the first portion 101 of the print media. Therefore, FIG. 1B is viewed as the fourth portion 104 appearing on one edge of the third portion 103.

FIG. 1C shows the fourth portion 104 along top and left edges of the print media with the third portion 103 comprising the bottom and right outer edges of the print media. Again, the orientation is relative, such that FIG. 1C may also be represented by the fourth portion 104 being along the bottom edge and the right edge of the print media. So, FIG. 1C represents the third portion 103 being surrounded along any two edges by the fourth portion 104.

FIG. 1D shows the fourth portion 104 along top, left, and bottom edges of the print media with the third portion 103 comprising the right edge of the print media. FIG. 1D represents the fourth portion 104 surrounding the third portion 103 along any three edges of the print media. It is noted that in this, and other embodiments, the adhesive 105 may comprise discontinuous strips (as shown), or a contiguous strip (not shown), as permitted by the embodiment. Variations, including flood coat of the fourth portion 104, are possible.

FIG. 1E shows another orientation of FIG. 1D, where the fourth portion 104 surrounds the third portion 103 along three edges of the print media.

Figure 1F:
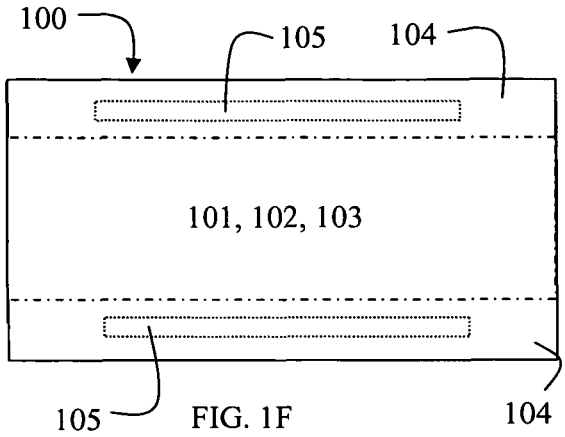

FIG. 1F shows still another orientation, where the fourth portion 104 borders the first portion 101 and second portion 102 along two parallel edges. Again, the first portion 101 may designed and/or imaged to include first information and the second portion 102 may be designed and/or imaged to include second information printed underneath the first portion 101, and both the first and second portions 101 and 102 combine to form a third portion 103. In the embodiment of FIG. 1F, the orientation may also be changed such that rather than having the fourth portion 104 border the first portion 101 from top to bottom, the border can occur from right to left sides of the first portion 101.

A label 100 as shown in, for example, FIG. 1F, can be of variable or custom length; that is, no predefined length of media need be provided to ensure, for example, consistent/repeat adhesive 105 patterns/coverage. As a result, variable (e.g., non-fixed quantity/length) information may be printed on one or both sides of media comprising the label 100, and the label 100 may then be appropriately cut-off to a desired or required length, whether such media is individually provided, e.g., in cut sheets, or provided in continuous, e.g., fan-fold or roll, form.

It is noted that, where provided in continuous (e.g., fan-fold or roll form), any of the disclosed embodiments and patterns (including, e.g., those of FIGS. 1A-1F and 2) may repeat along the running axis of the media web comprising, for example, the fan-fold stack or roll, wherein any given edge may be parallel or perpendicular to the running axis. Variations, including alternating embodiments and/or pattern orientations along the running axis, are possible.

It is also noted that other configurations of the label can exist as well. For example, the fourth portion 104 may not comprise a full outer edge or set of edges but only comprise a portion of any edge or set of edges for the print media.

The label 100 can also include adhesive material 105 that is affixed to a side (e.g., the back) of the fourth portion 104. The adhesive material can include such things as two-sided tape, glue, etc., and have varying tack/provide for varying degrees of adhesion (e.g., be removable, semi-permanent, or permanent).

This allows for the back side of the fourth portion 104 to be affixed or adhered to an object, such as packaging for a product or set of products being shipped. The third portion 103 is removable from the product along the perforation and/or die cut to become its own independent piece of the print media whereas the fourth portion 104 remains adhered to the object. Also, the third portion includes dual-sided image information that was thermally imaged on one or both the first portion 101 and the second portion 102 of the third portion 103.

It is now apparent how an improved label is constructed from only a one ply material. The one ply material is the print media having the third portion 103 and the fourth portion 104. There is only one disposable piece of waste being the third portion 103 that is removed from the fourth portion 104. This is more environmental friendly than previous labeling systems that can require upwards of four or more pieces of waste. This is also less expensive approach to labels for, for example, shipping, since just one print media is needed to ship and communicate other information to the recipient of shipping materials.

Figure 2:
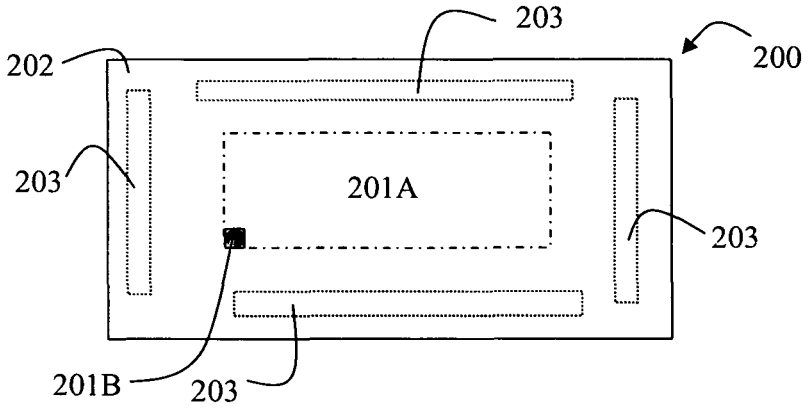
FIG. 2. is another diagram of a label apparatus, according to an example embodiment.

FIG. 2. is another diagram of a label apparatus 200, according to an example embodiment. The label apparatus 200 (hereinafter "label") can also take up any of the configurations depicted for the label apparatus 100 of the FIGS. 1A-1F or discussed with reference to the label apparatus 100 of the FIGS. 1A-1F, although it is noted that just one configuration and orientation of the label 200 is shown in FIG. 2.

The label 200 includes a first component 201A and a second component 202. In some cases, the label 200 also includes a tab element 201B and adhesive material 203. Each of these components and their relationship to one another is now discussed in detail below with reference to the FIG. 2.

The first component 201A of print media is variably thermally imaged on a front and back side of the print media. By variably thermally imaged it is meant that the print media has passed through a dual-sided thermal printer, such that the first component 201A is imaged (variably based on the print job) on both the front and back sides of the first component 201A.

So, unlike the label 100 of the FIG. 1, the label 200 of the FIG. 2 has already been thermally imaged on both sides to include variable information that a print job selectively imaged on the front side of the first component 201A and the back side of the first component 201A.

According to an embodiment, the first component 201A also includes a tab element 201B. The tab element 201B is integrated into or affixed to the first component 201A on the front side of the print media and is part of the first component 201A. In the embodiment of FIG. 2, the tab element 201B is located at the perforation or die cut outlining the first component 201A, and configured to permit the first component 201A to be separated from the second component 202 by a user grasping the tab element 201B and pulling upward. Variously, one or more outer edges (e.g., the left and bottom) of a tab element 201B may be die cut from a label 200 to permit the tab 201B to be grasped (e.g., by the lower left corner thereof), while the remainder of the perimeter of the first component 201A may be perforated, or die cut with, for example, small connector tabs remaining (e.g., in the upper left, upper right, and lower right corner thereof) to removably affix the first component 201A to the second component 202 of the label 200.

As shown, the second component 202 of the print media is attached to the first component 201A via perforation to permit the second component 202 to be removed from the first component 201A.

In other embodiments, die cuts in the print media may separate the first component 201A from the second component 202 and permit the first component 201 to be removed from the second component 202.

Initially, both the first component 201A and the second component 202 are attached to one another on the print media.

In one configuration, the second component 202 includes adhesive material 203 on the back side of the print media.

According to an embodiment, the back side having the adhesive material 203 is affixed to packaging. Here, the second component 202 remains a part of the packaging when the first component 201A is removed and separated from the second component 202.

Again, the second component 202 can completely surround the first component 201A, such that the first component 201A is situated at a center portion of the print media and the second component is situated along a perimeter of the print media. This is shown in FIGS. 1A and 2.

In other cases, the second component 202 is situated along at least one outer edge of the print media. This is shown in FIGS. 1B-1F. Again, the placement of the second component 202 does not have to take up a full edge or set of edges of the print media, as mentioned above with the discussion associated with FIGS. 1A-1F.

Figure 3:
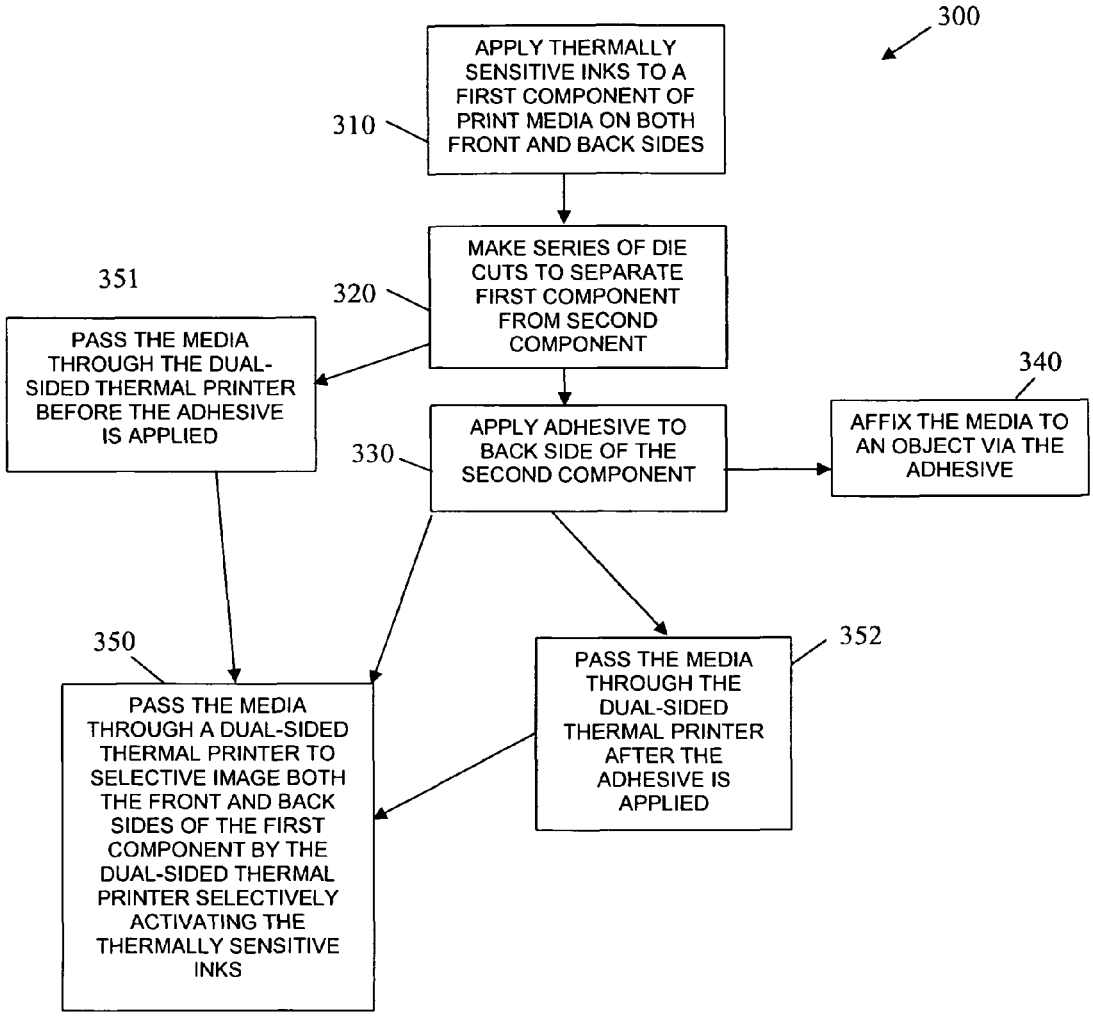
FIG. 3 is a diagram of a method for creating and using a label, according to an example embodiment.

FIG. 3 is a diagram of a method 300 for creating and using a label, according to an example embodiment. The method 300 (hereinafter "labeling process") is implemented in one or more machines adapted to process print media. The labeling process produces and uses the labels 100 and 200, discussed above with reference to the FIGS. 1A-1F and 2.

At 310, the labeling process applies thermally sensitive inks as coatings to a first component of one-ply print media. The thermally sensitive coatings are applied to both a front and back side of the one-ply print media. So, the single-ply print media is capable of being thermally imaged on two sides of the print media (both front and back sides of the print media).

At 320, the labeling process makes a series of perforations and/or dies cuts on the print media to permit separation of the first component of the print media from a second component that also comprises the print media. The first and second components remain affixed to one another.

At 330, the labeling process applies an adhesive to the back side of the second component. This permits the print media (comprising both the first and second components) to be affixed to an object via the adhesive materials applied to the back side of the second component.

According to an embodiment, at 340, the labeling process, via a machine, automatically affixes the media to an object via the adhesive. So, the machine that implements the labeling processing can also be used to affix the print media to an object.

It is noted, that the labeling process may be implemented via multiple machines, such that some processing (e.g., one or more of thermal coating application, adhesive application, perforation and/or die cutting, thermal printing, and/or affixing to an object) is achieved via one machine while other processing is achieved via one or more different machines. But, as noted above, in some embodiments, all processing may be achieved via a single machine that implements the labeling process.

In an embodiment, at 350, the labeling process passes the print media through a dual-sided thermal printer to selectively image both the front and back sides of the first component. This is done by the dual-sided thermal printer selectively activating the thermally sensitive inks coated on the front and back sides of the first component, as described at 310.

In one case with the embodiment of 350 and at 351, the labeling process passes the print media through the dual-sided thermal printer before the adhesive is applied to the back side of the second component.

In another case with the embodiment of 350 and at 352, the labeling process passes the print media through the dual-sided thermal printer after the adhesive is applied to the back side of the second component.

It is also noted that the adhesive does not have to be applied to all of the back side of the second component. So, there can be a pattern of adhesive applied on the back side of the second component in any configured or desired manner.

Further, a release material (e.g., silicone) may be applied to and/or provided on a side of the media opposite the side comprising the adhesive, such that it covers and/or otherwise contacts the adhesive when in fan-fold and/or roll form, to permit the media to be fan-folded and/or rolled, and subsequently un-fan-folded and/or un-rolled without the adhesive permanently bonding the fan-fold stack and/or roll layers together, as relatedly described with respect to, for example, U.S. Pat. No. 7,588,811 the contents of which are incorporated by reference herein in their entirety for all purposes.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A label, comprising:

a first portion of media situated on a front side of the media and coated with thermally sensitive inks;

a second portion of the media situated on a back side of the media and coated with the thermally sensitive inks;

a third portion of the media comprising the first and second portions; and a fourth portion of the media perforated to separate the fourth portion from the third portion, the third portion removable from the fourth portion, the third portion representing the only disposable piece of waste for the label and the first portion of the third portion is thermally imaged with a mailing address for a good being shipped and the second portion of the third portion is thermally imaged with the packing slip, the first portion front-facing and visible on an object to which label is affixed whereas the second portion is back-facing and hidden from view on the object to which the label is affixed, and wherein the fourth portion is configured along at least one outer edge of the media the third portion is configured along at least some part of remaining edges of the media.

2. The label of claim 1, wherein the media comprises a single-ply substrate.

3. The label of claim 1, wherein the receipt includes two or more colors on each of the first and second portions.

4. The label of claim 1, wherein the fourth portion includes adhesive material on at least some parts of the back side of the fourth portion.

5. The label of claim 1, wherein the back side of the fourth portion is affixed to packing material for a product, the third portion removable from the fourth portion and the packing material.

* * * * *